US005508796A

United States Patent [19]

Sasame et al.

[11] Patent Number: 5,508,796

[45] Date of Patent: Apr. 16, 1996

[54] IMAGE FORMING APPARATUS WITH SELECT RELATION AMONG DISTANCES IN RECORDING MATERIAL CONVEYANCE PATH

[75] Inventors: Hiroshi Sasame, Yokohama; Takao Aoki, Abiko; Haruo Fujii, Yokohama; Toshihiko Ochiai, Tokyo; Motoi Kato, Yokohama; Tatsuya Kobayashi, Soka; Tetsuya Kobayashi, Kawasaki; Toshiaki Miyashiro, Ichikawa; Naoki Enomoto; Akihiko Uchiyama, both of Yokohama; Yoshiro Saito, Kawasaki; Takehiko Suzuki; Yoichiro Maebashi, both of Yokohama, all of Japan

[73] Assignee: Canon Kabushiki Kaisha, Tokyo, Japan

[21] Appl. No.: 215,710

[22] Filed: Mar. 22, 1994

[30] Foreign Application Priority Data

Mar. 23, 1993 [JP] Japan ..... 5-088226

[51] Int. Cl.[6] ..... G03G 15/14

[52] U.S. Cl. ..... 355/271; 355/207; 355/326 R

[58] Field of Search ..... 355/271, 274, 355/277, 326 R, 327, 205, 207

[56] References Cited

U.S. PATENT DOCUMENTS 5,239,347 8/1993 Onodera et al. ..... 355/274
5,249,023 9/1993 Miyashiro et al. .
5,287,163 2/1994 Miyashiro et al. .

FOREIGN PATENT DOCUMENTS 50-93437 7/1975 Japan .

*Primary Examiner*—A. T. Grimley
*Assistant Examiner*—Shuk Y. Lee
*Attorney, Agent, or Firm*—Fitzpatrick, Cella, Harper & Scinto

[57] ABSTRACT

The present invention provides an image forming apparatus with an image bearing member capable of rotating while bearing a toner image thereon, a transfer device for transferring the toner image from the image bearing member to a recording material at a transfer position, recording material bearing member capable of rotating while bearing the recording material thereon and adapted to convey the recording material to the transfer position, a pair of rotary members arranged at an upstream side of the recording material bearing member in a recording material conveying direction and adapted to pinch and convey the recording material, and a separation device for separating the recording material from the recording material bearing member at a separation position. When a length from the pair of rotary members to the separation position along a recording material conveying path is L1, a length of the recording material in the recording material conveying direction is L3, a length from the transfer position to the separation position is L4 and a sheet-to-sheet distance between two adjacent recording materials is La, the following relations are satisfied:

$L1<(L3+La)$, and, $L4<La$.

9 Claims, 6 Drawing Sheets

IMAGE FORMING APPARATUS WITH SELECT RELATION AMONG DISTANCES IN RECORDING MATERIAL CONVEYANCE PATH

BACKGROUND OF THE INVENTION

1. Field of the Invention

The present invention relates to an image forming apparatus such as a copying machine, a printer and the like, and more particularly, it relates to an image forming apparatus having an image bearing member capable of bearing an electrostatic latent image and toner image and a recording material bearing member capable of bearing a recording material.

2. Related Background Art

As an image forming apparatus having an image bearing member and a recording material bearing member, color image forming apparatuses are already known. Among such color image forming apparatuses, a color image forming apparatus wherein toner images having different colors formed on an image bearing member by charging, exposure and development are successively transferred onto a recording material in a superposed fashion to obtain a full-color image has been put to practical use.

An example of a four color image forming apparatus will be briefly explained with reference to FIG. 4.

This image forming apparatus includes a photosensitive drum 1 as an image bearing member that is rotatably supported. The photosensitive drum 1 is constituted by an aluminum cylinder having a diameter of about 40 mm, for example, and a photo-conductive layer made of organic photosensitive material (OPC) and coated on a peripheral surface of the cylinder. The photosensitive drum 1 is rotated by a drive means (not shown) in a direction shown by the arrow R1 at, for example, a peripheral speed of 100 mm/sec. Incidentally, the photo-conductive layer is not limited to OPC, but may be made of A—Si, CdS, Se or the like. Around the photosensitive drum 1, in order along a rotational direction thereof, there are arranged a charge device 2, an exposure device 3, a developing means 5, a transfer device 6, a cleaning device 7 and the like. The charge device 2 comprises a charge roller contacted with a surface of the photosensitive drum 1 and adapted to apply vias voltage, thereby uniformly charging the surface of the photosensitive drum 1. For example, the vias voltage obtained by overlapping DC voltage of −700 V to AC voltage having AC frequency of 1000 Hz and peak-to-peak voltage Vpp of 1500 V is applied to the charge roller, thereby uniformly charging the surface of the photosensitive drum 1 to −700 V.

The exposure device 3 is disposed above the photosensitive drum 1 and has an optical unit 10 including a laser diode for emitting laser light, a polygon mirror rotated by a high speed motor, a lens and the like, and a reflection mirror 11. For example, when a signal corresponding to image information for each color is inputted to the charge device, the charge device illuminates the laser light onto the surface of the photosensitive drum 1 through a light path E to change the voltage of the illuminated portion to about −100 V, thereby forming an electrostatic latent image The developing means 5 serves to adhere toner to the electrostatic latent image and has a rotary member 13 rotatably supported on a shaft 12, and four developing devices (i.e. yellow developing device 15Y containing yellow toner, magenta developing device 15M containing magenta toner., cyan developing device 15C containing cyan toner and black developing device 15BK containing black toner) mounted on the rotary member 13. These four developing devices have substantially the same construction as each other. Explaining the yellow developing device 15Y shown in FIG. 5, the developing device 15Y comprises a coating roller 16, a developing roller 17 and a toner regulating member 19, so that, as the developing roller 17 is rotated, the toner is coated on the developing roller 17 by the coating roller 16, the thickness of a toner layer on the developing roller is regulated and the desired triboelectric brush is applied to the toner by the toner regulating member. The toner regulating member 19 may be made of material having charging polarity opposite to the charging polarity of toner (for example, nylon when the toner is to be negatively charged, or silicone rubber when the toner is to be positively charged).

Further, preferably, a peripheral speed of the developing roller 17 is selected to be greater than the peripheral speed of the photosensitive drum 1 by 1.0 to 2.0 times. Furthermore, as shown in FIG. 4, an opening **15*a* of each developing device is opposed to the surface of the photosensitive drum 1 when the desired developing device is brought to a developing position by rotating the rotary member 13. In the developing position, the toner from the developing device is transferred onto the electrostatic latent image on the photosensitive drum 1. Incidentally, a drive means for driving the rotary member 13** is fully described in the Japanese Patent Laid-open No. 50-93437, for example.

The transfer device 6 for transferring the toner image formed on the photosensitive drum 1 onto a recording material is disposed in a confronting relation to the developing means 5 with the interposition of the photosensitive drum 1. The transfer device 6 comprises a cylindrical transfer drum 20 rotatably supported for rotation in a direction shown by the arrow R2. The transfer drum 20 is constituted by a metallic cylinder 21 having a diameter of 156 mm, for example, an elastic layer 22 made of foam urethane and having a thickness of 2 mm and wound around the metallic cylinder, and a PVDF layer 23 having a thickness of 100 μm and wound around the elastic layer. A recording material supplied from a sheet supply cassette 9 by a pick-up roller (not shown) is gripped by a gripper 25 and then is electrostatically wound around the surface of the transfer drum 20 by an absorb roller 26 to which voltage is applied. The toner image formed on the photosensitive drum 1 is transferred onto the recording material wound around the transfer drum by a transfer voltage from a power source (not shown).

The above-mentioned series of image forming processes from the charging step to the transferring step are repeated by four timers for different colors. That is to say, by such image forming processes, four toner images having different colors are transferred onto the recording material born by the transfer drum 20 in a superposed fashion. The recording material to which the toner images were transferred is separated from the transfer drum 20 by a separation pawl 30 and is sent to a fixing device 32 by a convey device 31. Then, the recording material is heated by the conventional fixing device 32 having a heat roller 32a and a pressure roller **32*b***, so that the toners are fused and mixed to form a permanent color image on the recording material. Then, the recording material is discharged onto a discharge tray (not shown) out of the apparatus.

On the other hand, the residual toner remaining on the photosensitive drum 1 is removed by the cleaning device 7 comprising a conventional fur brush, blade or the like. Further, the residual toner remaining on the transfer drum 20 is also removed by a transfer drum cleaning device 33 comprising a fur brush, web or the like, if necessary. Further, the transfer drum from which the residual toner was removed is initialized by removing the charge from the surface of the drum by means of an electricity removal roller 35.

Now, a fixing operation of the fixing device 32 will be fully explained. In a color image forming apparatus, not only natural color but also seven colors (such as red, green, blue and the like) cannot be obtained unless at least the yellow toner, magenta toner and cyan toner are fused and mixed. Thus, the toner must be of sharp melt type which can easily be mixed, and, in the fixing device 32, when the recording material is pinched between the upper fixing roller 32*a* and the lower pressure roller 32*b*, a fixing nip N2 for contacting the recording material with the rollers 32*a*, 32*b* must be widened sufficient to apply adequate heat amount to the toner. In addition, adequate pressure must be applied to easily mix the different color toners. More specifically, in a standard monochrome image forming apparatus, the pressure may be in the order of 5 to 10 kg; whereas, in the color image forming apparatus, the pressure is normally in the order of 30 to 50 kg.

However, in the above-mentioned image forming apparatus wherein the toner images are formed on the recording material wound around the recording material bearing member, the following problems arise:

First of all, as shown in FIG. 4, in an image forming apparatus wherein a distance between a transfer nip N1 and the fixing nip N2 becomes greater than a length of a recording material in a conveying direction so that the fixing operation is started after the transferring operation is completely finished, upon continuous print, if a next or second recording material and so on is miss-supplied or jammed due to the failure of the gripper, at this point, when the toner images are completely transferred to a first recording material and preferably is separated from the transfer drum 20 (that is, when a trailing end of the first recording material has passed through the transfer nip N1), a sheet supply portion, transfer drum 20 and the like are immediately stopped, and only the convey device 31 (between the transfer drum 20 and the fixing device 32) fixing device 32 and discharge device (not shown) are driven. The convey device, supply device, rollers and the like associated with the jam are immediately stopped in order to prevent the damage of the transfer drum 20 during the jam treatment and to improve the jam treating operability. In this way, if the second recording material is jammed, when the first recording material has passed through the transfer nip N1, the normal fixing operation can be effected regarding the first recording material, and the first recording material can be discharged as a correct copy sheet. That is to say, the number of recording materials which should be subjected to the jam treatment is minimized, thereby reducing the number of the waste recording materials and the jam treatment time.

Further, if the next or second recording material and so on is miss-supplied or jammed due to the failure of the gripper, when the transferring of the toner images regarding the first recording material is not completed, the sheet supply device, transfer drum 20, fixing device 32, discharge device and the like are immediately stopped. In such a case, since the first recording material is not yet sent to the fixing device 32, such recording material can easily be removed (jam treatment).

However, as shown in FIG. 6, when the apparatus is made compact by reducing the distance between the transfer nip N1 (referred to as "transfer point Q" hereinafter) and the fixing nip N2 (referred to as "fixing point S" hereinafter), upon the continuous print, if the next or second recording material and so on is miss-supplied or jammed due to the failure of the gripper, in almost cases, since the transferring of the toner images onto the first recording material is not completed and a tip end of the first recording material has already reached the fixing device 32, the first recording material not directly associating with the jam is in vain and this first recording material must also be removed during the jam treatment. That is to say, if the second recording material is jammed, the first recording material not directly associated with the jam must also be removed, and this removing operation is very dangerous-since the recording material should be removed from the fixing device 32 under high temperature and high pressure. Further, after the jam treatment, when the image formation is re-started, the image must be formed on a new recording material, thereby wasting the recording material and increasing the image forming time.

SUMMARY OF THE INVENTION

The present invention intends to eliminate the above-mentioned conventional drawbacks, and has an object to provide an image forming apparatus which does not waste recording materials.

Another object of the present invention is to provide an image forming apparatus wherein, when a distance between a pair of rotary members and a separation position in a recording material conveying path is $L_1$, a length of a recording material in a conveying direction is $L_3$, a length between a transfer position and the separation position is $L_4$, and a distance between adjacent recording materials during continuous image formation is La, the following relations are established:

$$L_1<(L_3+La) \text{ and } L_4<La.$$

The other objects of the present invention will be apparent from the following detailed explanation.

DETAILED DESCRIPTION OF THE PREFERRED EMBODIMENTS

The present invention will now be explained in connection with embodiments thereof with reference to the accompanying drawings.

(First Embodiment)

Figure 1:
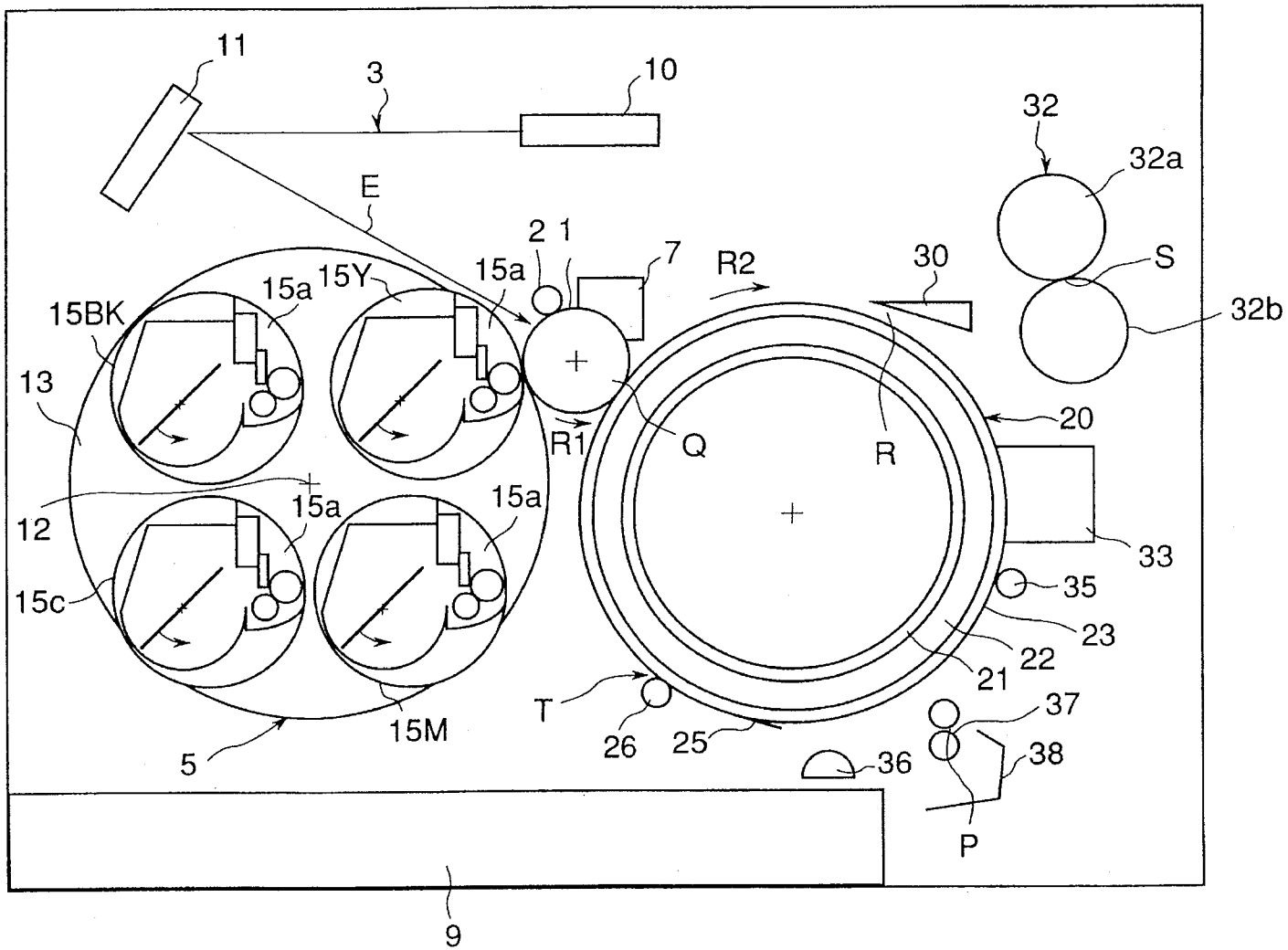
FIG. 1 is a longitudinal sectional view of an image forming apparatus.
Figure 4:
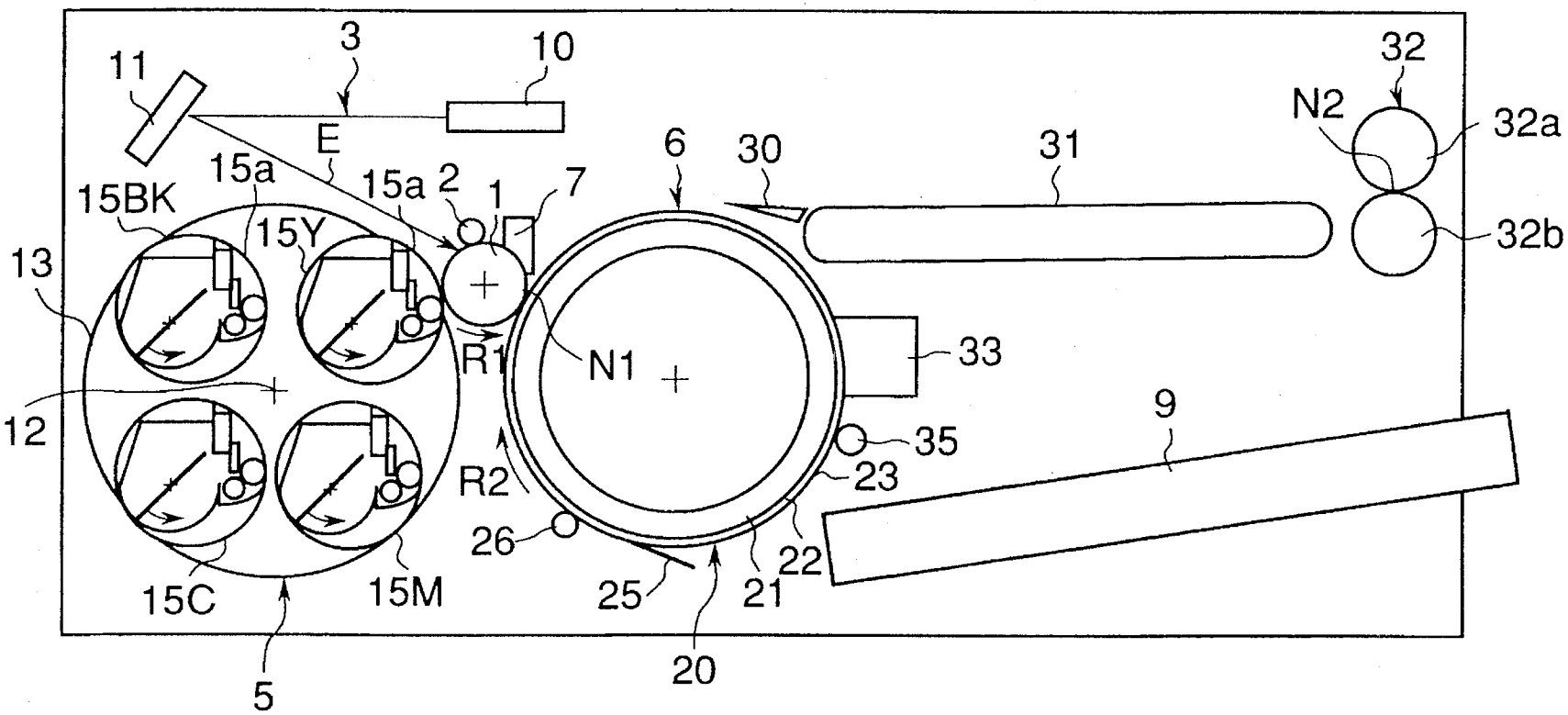
FIG. 4 is a schematic longitudinal sectional view of a conventional image forming apparatus.
Figure 5:
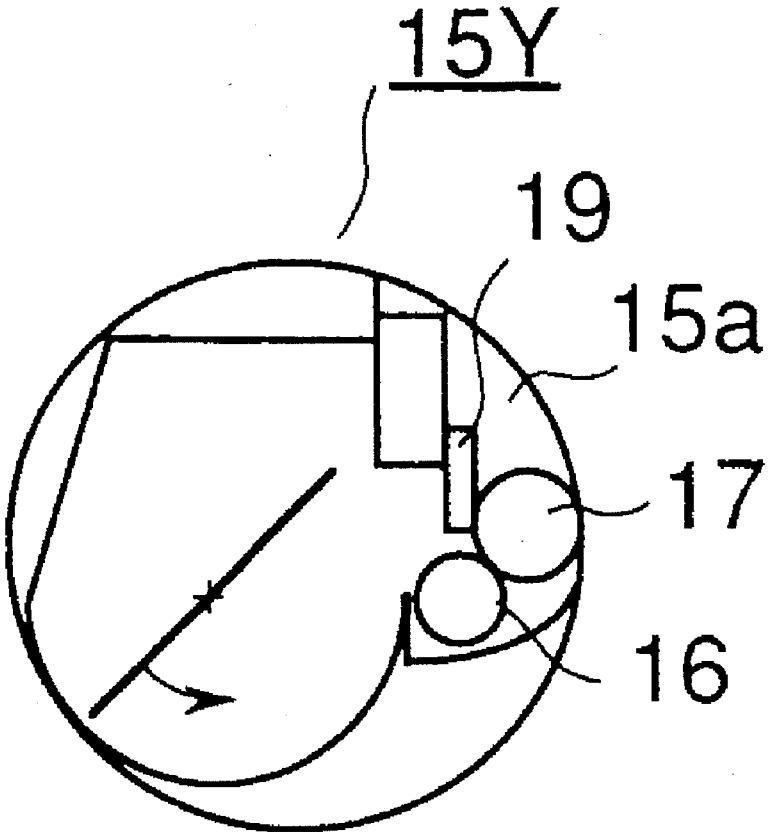
FIG. 5 is a cross-sectional view of a developing device used with the image forming apparatus of FIG. 4.
Figure 6:
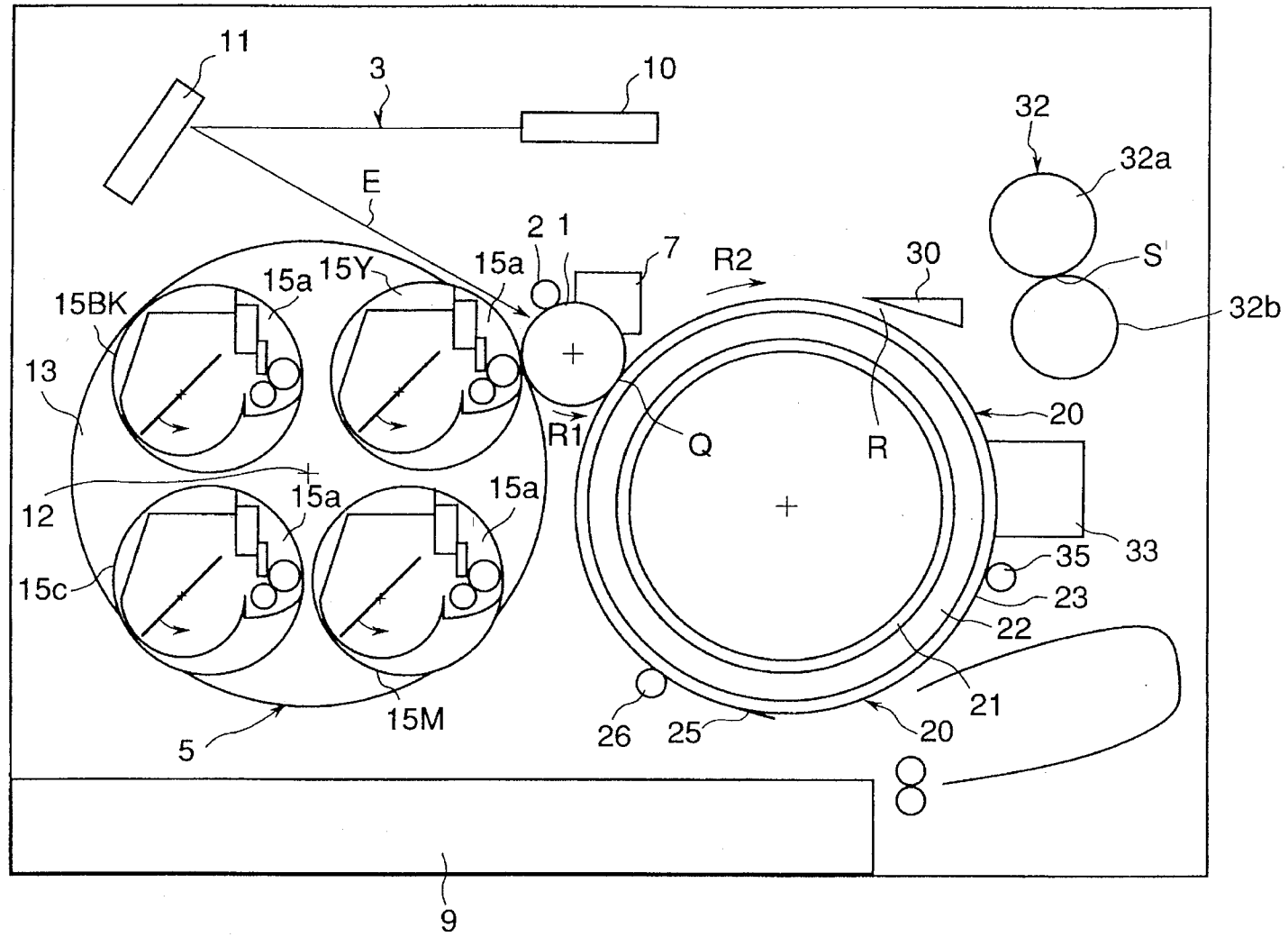
FIG. 6 is a schematic longitudinal sectional view of another conventional image forming apparatus.

FIG. 1 schematically shows an image forming apparatus according to the present invention. Incidentally, the same constructural and functional elements as those shown in FIGS. 4, 5 and 6 are designated by the same reference numerals and explanation thereof will be omitted.

A semi-circular pick-up roller 36 is arranged above a sheet supply cassette 9 at a leading portion (right in FIG. 1) thereof in a lower portion of the image forming apparatus. The pick-up roller 36 serves to supply the recording materials stored in the sheet supply cassette 9 one by one from an uppermost one. A guide 38 for guiding the recording material supplied by the roller 36 and for changing a conveying direction of the recording material by about 180 degrees is arranged at a downstream side of the pick-up roller 36. At a downstream side of the guide 38, there are arranged a pair of regist rollers (rotary members) 37 against which a tip end of the recording material is abutted and which serve to supply the recording material to a transfer drum 20 at a predetermined timing.

Figure 2:
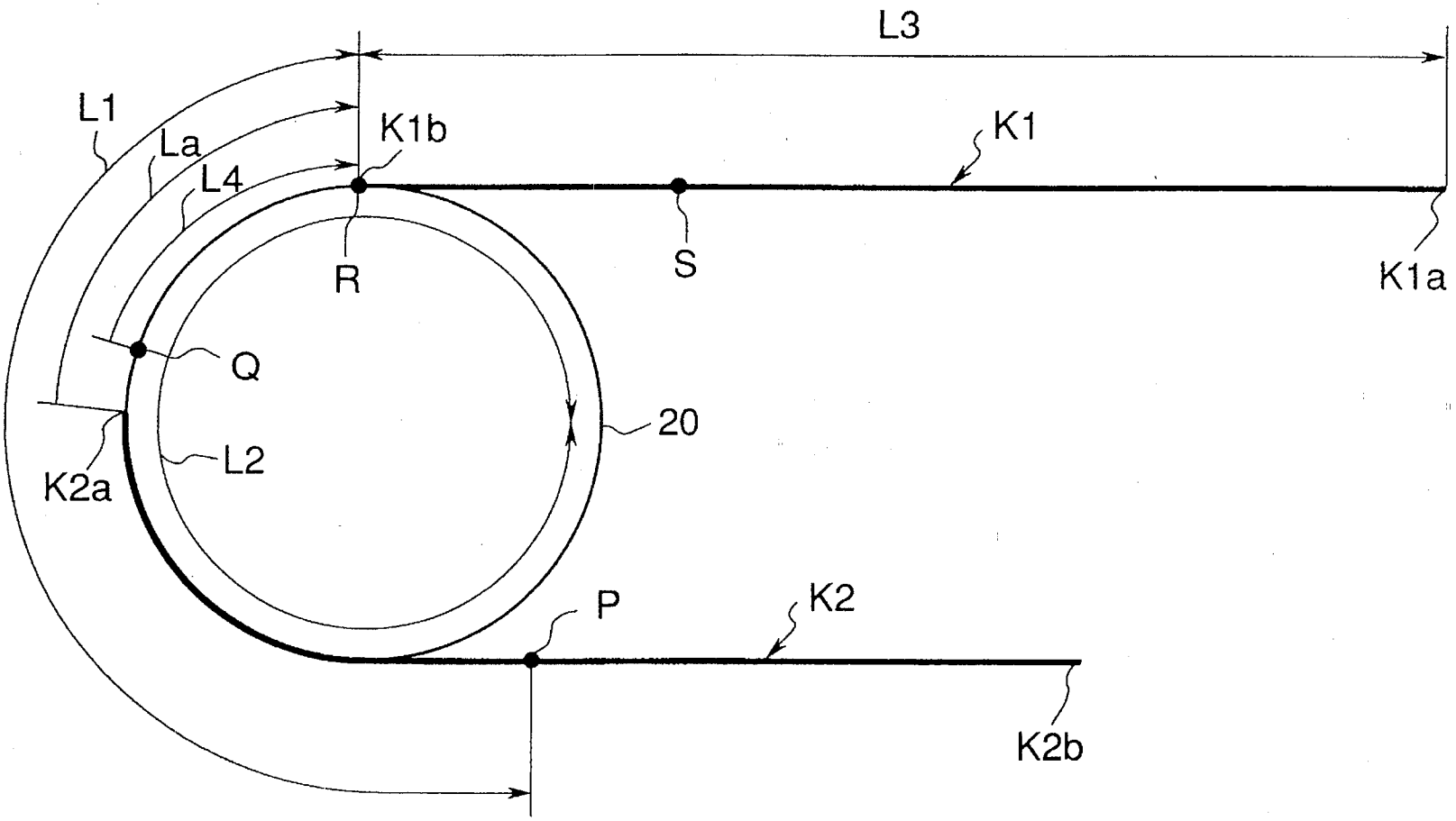
FIG. 2 is a schematic view showing relations between points P, Q, R, S and lengths L1, L2, L3, L4 in an image forming apparatus according to the present invention.

Now, it is assumed that a nip between the upper and lower regist rollers 37 is a supply point P, a nip between the transfer drum (recording material bearing member) 20 and a photosensitive drum (image bearing member) 1 is a transfer point Q, a position of a tip end of a separation pawl (separation member) 30 for separating the recording material from the transfer drum is a separation point R, a nip between a fixing roller 32*a* and a pressure roller 32*b* of a fixing device 32 is a fixing point S, a length from the supply point P to the separation point R is L1, a peripheral length of the transfer drum 20 is L2, a length of the recording material in a conveying direction (referred to as "recording material size" hereinafter) is L3, a length from the transfer point Q to the separation point R is L4, and a distance between two adjacent recording materials continuously supplied is La. A relation between these points P, Q, R, S and length L1, L2, L3, L4 is schematically shown in FIG. 2.

According to the present invention, the length L1 from the supply point P to the separation point R is selected to be smaller than sum of L3 and La. With this arrangement, among two continuously supplied recording materials, if the recording material next to the recording material which has reached the transfer point Q is jammed, the jammed recording material is pinched between the pair of regist rollers (rotary members) 37 when it is just jammed. Thus, when the pair of regist rollers 37 are stopped while pinching the recording material therebetween, even when the transfer drum 20 continues to be rotated, the jammed recording material is not conveyed. Further, regarding the preceding recording material which is not jammed, by continuing the photosensitive drum 1, transfer drum 20, fixing roller 32*a* and pressure roller 32*b* to rotate, the toner images can be formed on such recording material, as is in the normal case. Accordingly, among the recording materials being conveyed, if the succeeding recording material is jammed, upon jam treatment, only one (jammed) recording material may be removed from the apparatus, and the toner images can be formed on the preceding recording material, as is in the normal case.

Incidentally, if the succeeding recording material is jammed, the pair of regist rollers 37 are stopped, but the photosensitive drum 1, transfer drum 20, fixing roller 32*a* and pressure roller 32*b* continue to be rotated. The photosensitive drum 1 and transfer drum 20 continue to be rotated at least until the trailing end of the preceding recording material passes through the separation point R. When the trailing end passes through the point P, the photosensitive drum 1 and transfer drum 20 may be stopped. Thus, after the trailing end of the preceding recording material has passed through the fixing point S, the photosensitive drum 1, transfer drum 20, fixing roller 32*a* and pressure roller 32*b* may be stopped simultaneously.

Incidentally, in the illustrated embodiment, jam detection sensors are arranged at a position (point T in FIG. 1) where a tip end of the recording material is gripped by the transfer drum 20, and a position corresponding to the separation point R, respectively. Accordingly, in the image forming apparatus according to the first embodiment, if the recording material is not separated from the transfer drum 20 at the separation point R or if the tip end of the recording material is not gripped by the transfer drum 20 at the grip point T when a predetermined time period is elapsed after the tip end of the recording material passes through the pair of regist rollers 37, it is judged that the recording material is jammed. In the case where the toner images are formed on a plurality of recording materials continuously supplied, if the jam of the recording material is detected at the grip point T, as mentioned above, the pair of regist rollers 37 are stopped, but the photosensitive drum 1, transfer drum 20, fixing roller 32*a* and pressure roller 32*b* continue to be rotated.

On the other hand, if the jam of the recording material is detected at the separation point R, all of the photosensitive drum 1, transfer drum 20, fixing roller 32*a*, pressure roller 32*b* and pair of regist rollers 37 may be stopped. Regarding the jam detection at the separation point R, in almost cases, a condition that the tip end of the recording material is not separated from the transfer drum 20. Thus, on the basis of the relation L1<(L3+La), if the jam of the recording material is detected at the separation point R, since the tip end of the succeeding recording material is not pinched between the pair of regist rollers 37, also in this case, only the actually jammed recording material may be removed.

Incidentally, in the illustrated embodiment, since a gripper 25 for gripping the tip end of the recording material is provided on the transfer drum 20, the tip end of the recording material is gripped always at the same position in the peripheral direction of the transfer drum 20. Thus, there is the following relation between the peripheral length L2 of the transfer drum and the length L3 of the recording material L3 and the sheet-to-sheet distance La:

$$L2=L3+La.$$

Accordingly, the above-mentioned relation L1<(L3+La) can be represented as follows:

$$L1<L2.$$

More specifically, as mentioned above, since a diameter of the transfer drum is 160 mm, the peripheral length L2 of the transfer drum becomes 502.7 mm, and, in the illustrated embodiment, the length L1 from the supply point P to the separation point R (along the conveying path) is selected to 350 mm. Further, the length L4 (between the transfer point and the separation point) is selected to 10 mm. Incidentally, the 10 recording material size is A4 longitudinal (297 mm) or REGAL longitudinal (455.6 mm) or B5 longitudinal (257 mm).

Next, the operation will be explained with reference to FIGS. 1 and 2.

First of all, the first preceding recording material K1 supplied by the pick-up roller 36 is stopped by the regist rollers 37 to obtain a predetermined timing with respect to the gripper 25 of the transfer drum 20. Then, the recording material K1 is fed out in a timed relation to the gripper 25 so that the recording material is gripped by the gripper and is electrostatically absorbed on a dielectric sheet around the transfer drum. Then, the transfer operation is effected. In this condition, three different color toner images (among four colors) are transferred. Regarding the fourth color toner image, upon continuous print, a second succeeding recording material K2 is supplied by the pick-up roller 36 and is stopped by the regist rollers 37. Of course, meanwhile, the preceding recording material K1 continues to move. As the fourth color toner image is being transferred onto the recording material K1, the tip end K1*a* of the preceding recording material K1 started to be separated by the separation pawl 30. In this way, the tip end of the recording material is separated while transferring the fourth color toner image. During this operation, when the gripper 25 reaches the grip point for the succeeding recording material K2, the succeeding recording material K2 is gripped.

At this point or thereafter, if any miss (including not only the poor gripping but also a case where the recording material K2 does not reach the gripper 25 due to the poor conveyance) is detected by a recording material detection means disposed in the proximity of the gripper 25, the regist rollers 37 are stopped to prevent the jammed recording material from advancing downstreamly from the jammed position. On the other hand, in this case, since the transferring process and the separation process, or the separation process regarding the preceding recording material K1 is not often completed, the transferring process and the separation process continue to be effected. When the transferring process, separation process and fixing process are finished, the apparatus is stopped and the jam condition is displayed or the jam status is sent to a host computer.

In this way, if the succeeding recording material is jammed due to the poor sheet supply or the like, the image formation regarding the preceding recording material is performed as is in the normal case and the preceding recording material is discharged onto the discharge tray (not shown) out of the apparatus as a correct print. On the other hand, since the jammed recording material is stopped by the regist rollers 37, the transfer drum 20 and the photosensitive drum 1 are not damaged by the jammed recording material, and the jam treatment can be facilitated. That is, the preceding recording material which is not jammed is not in vain, and, regarding the jam treatment, since the chance that the jammed succeeding recording material K2 is removed while remaining the preceding recording material K1 in the fixing device 32 is greatly reduced, the troublesome operation such that the preceding recording material K1 pinched in the fixing device 32 under the high temperature and high pressure condition should be removed can be eliminated. Further, after the jam treatment, when the image formation is re-started, since the image formation may not be effected regarding the preceding recording material K1, it is possible to save the resources and the image forming time.

Now, the condition for attaining the above operation, i.e. a relation between the length L1 (P–R), length L2 (peripheral length of transfer drum 20), length L3 (recording material size) and length L4 (Q–R) will be explained again.

In order to attain the above operation, if the second succeeding recording material K2 is not pinched between the regist rollers 37 until the first preceding recording material K1 is completely separated, i.e. until the trailing end K1*b* of the preceding recording material K1 reaches the separation point R, when the jam is detected, the second succeeding recording material K2 cannot be stopped. Accordingly, the sum of the recording material size L3 and the sheet-to-sheet distance La (distance between the trailing end K1*b* of the preceding recording material K1 and the tip end K2*a* of the succeeding recording material K2) must be greater than the length L1 from the supply point P to the separation point R. That is to say:

$$L1<(L3+La) \quad (1)$$

As is in the illustrated embodiment, in the multi-color image forming apparatus wherein a color image is formed on the recording material by transferring toner images on the recording material wound around the transfer drum 20 in a superposed fashion, since a tip end position of the recording material wound around the transfer drum 20 is fixed, a relation between the peripheral length L2 of the transfer drum 20, recording material size L3 and sheet-to-sheet distance La becomes as follows:

$$La=L2-L3 \quad (2)$$

Accordingly, from the above relations (1) and (2), the following relation is established:

$$L1<L2 \quad (3)$$

Further, it is necessary that the second recording material K2 does not reach the transfer point Q until the separation of the first recording material K1 is finished. Otherwise, if the jammed second recording material K2 tries to be held by the regist rollers 37 until the separation of the first recording material K1 is finished, the second recording material K2 reaches the transfer point Q, so that the second recording material K2 is pinched between the transfer drum 20 and the photosensitive drum 1. As a result, the second recording material K2 is pulled toward the supply point P or the transfer point Q, thereby making the holding of the recording material difficult, and there arises the risk that the transfer drum 20 and/or the photosensitive drum 1 are damaged. Accordingly, the second recording material K2 should not reach the transfer point Q until the separation of the first recording material K1 is finished.

To this end, the sheet-to-sheet distance La (particularly, distance La when the continuous print is effected regarding the maximum size recording material available to the image forming apparatus) may be greater than the length L4 between the transfer point and the separation point. Accordingly, various value may be selected to satisfy the following relation:

$$L4<(L2-L3).$$

(Second Embodiment)

Next, a second embodiment of the present invention will be explained. Incidentally, since the construction of the image forming apparatus according to the second embodiment is the same as that of the first embodiment, explanation thereof will be omitted and only the operation will be described.

The image forming processes regarding the first recording material K1, and the supplying process for supplying the second recording material K2 to the transfer drum 20 are the same as those in the first embodiment. In this second embodiment, if the second recording material K2 is jammed, the second recording material K2 is stopped by the regist rollers 37. On the other hand, it is judged whether the separation of the first preceding recording material K1 is finished or not. If finished, the transfer drum 20 and the photosensitive drum 1 are immediately stopped, and only the fixing device 32 is driven so that the first preceding recording material K1 is discharged as the correct print. If the separation of the first preceding recording material K1 is not completed, the image forming operation is continued, and, at the time when the separation of the first preceding recording material K1 is finished, the transfer drum 20 and the photosensitive drum 1 are immediately stopped, and only the fixing device 32 is driven so that the first preceding recording material K1 is discharged as the correct print.

In this way, since the transfer drum 20 can be stopped at minimum time without loosing the effect of the first embodiment, it is possible to minimize the rubbing of the jammed recording material K2 against the transfer drum 20, thereby preventing the transfer drum 20 from damaging.

(Third Embodiment)

Figure 3:
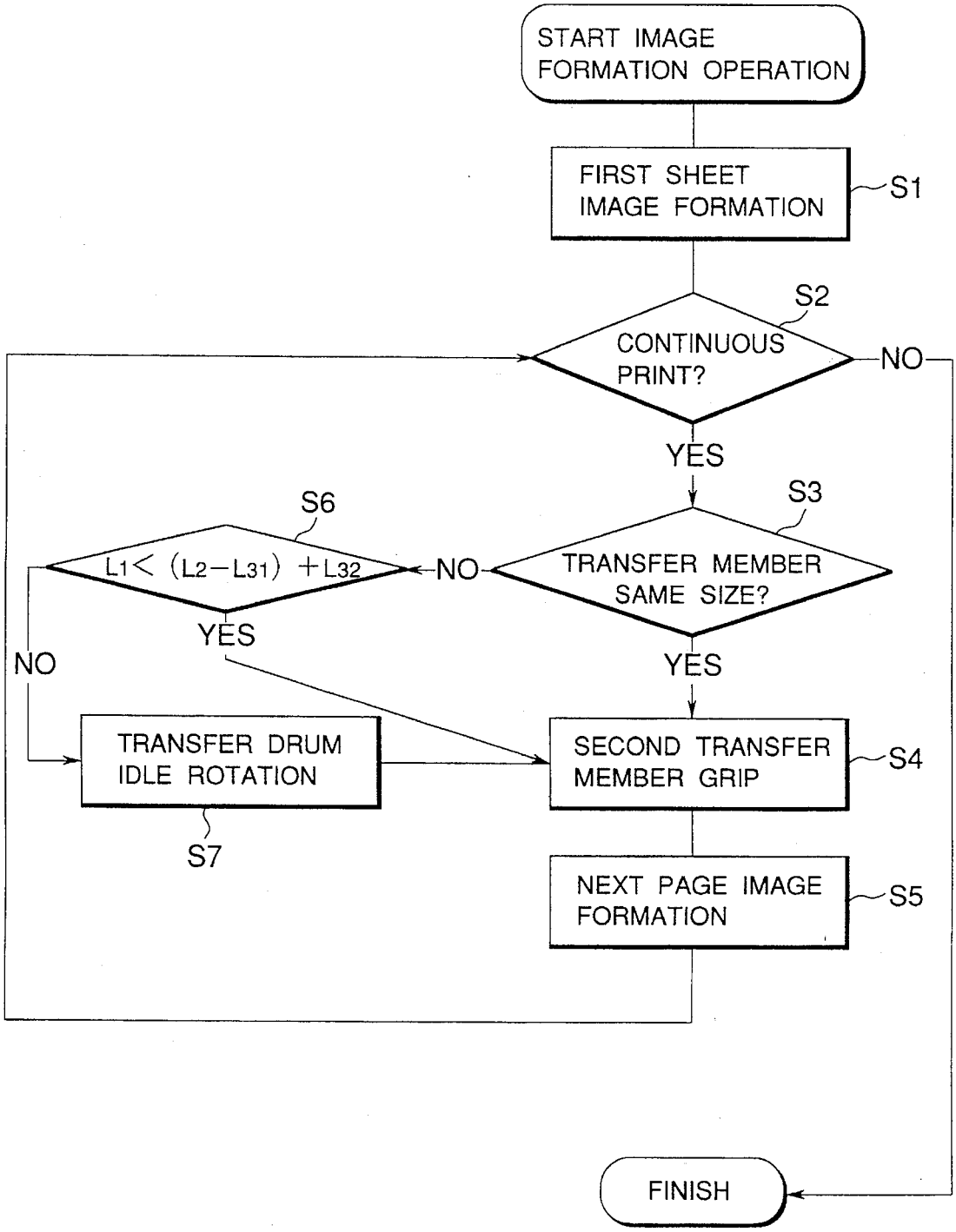
FIG. 3 is a flow chart showing an operation of the image forming apparatus according to the present invention.

FIG. 3 is a flow chart showing the operation according to the third embodiment. Since the construction of the image forming apparatus according to the third embodiment is the same as that of the first embodiment, explanation thereof will be omitted.

Now, the operation will be explained. In the first and second embodiments, while the recording material size was A4 longitudinal (297 mm) or REGAL longitudinal (355.6 mm) or B5 longitudinal (257 mm), in this third embodiment, the recording material size is A6 longitudinal (148.5 mm). In this case, when the continuous print is effected by using the same size recording materials, since the same operation as that of the first or second embodiment can be performed, there is no problem. Further, when the recording material size is gradually changed from the smaller one to the larger one, there is also no problem.

However, when the recording material size is changed from the maximum one to the minimum one, the succeeding recording material K2 leaves the regist rollers 37 before the separation of the preceding recording material K1 is finished. That is to say, when the REGAL size is changed to A6 size, as the A6 size recording material leaves the regist rollers 37, since the trailing end of the preceding REGAL size recording material is positioned at an upstream side of the separation point R by 54.4 mm, the means described in connection with the first and second embodiments cannot be applied.

Thus, when the maximum size is continuously changed to the minimum size as mentioned above, the recording materials are not continuously supplied. That is, after the preceding large size recording material K1 is supplied, the transfer drum 20 is idly rotated by one revolution, and then the succeeding small size recording material K2 is wound around the transfer drum 20. In this case, although the continuous print speed is reduced more or less, since there is a rare case where the maximum size is changed to the minimum size and since the idle rotation of the transfer drum may be effected only when the recording material size is changed, there arises no practical problem regarding the print speed. Also in this embodiment, as is in the first and second embodiments, the first preceding recording material K1 which is not jammed is not in vain, and, the troublesome jam treatment while remaining the recording material K1 in the high temperature and pressure fixing device 32 can be greatly reduced. Further, after the jam treatment, when the image formation is re-started, since the image formation may not be effected regarding the preceding recording material K1, it is possible to save the resources and the image forming time.

Now, the condition for attaining the above condition, i.e. a relation between the length L1 from the supply point P to the separation point R, peripheral length L2 of the transfer drum 20, first recording material size L31, second recording material size L32 and length L4 from the transfer point Q to the separation point R will be explained again.

In order to achieve the technical effects of the aforementioned first and second embodiments, if the second recording material K2 is not pinched between the regist rollers 37 until the first recording material K1 is completely separated, i.e. until the trailing end K1*b* of the first recording material K1 reaches the separation point R, when the jam is detected, the second recording material K2 cannot be stopped. That is to say, the sum of the second recording material size L32 and the sheet-to-sheet distance La must be greater than the length L1 from the supply point P to the separation point R. Accordingly, the following relation must be established:

$$L1<(La+L32) \quad (4)$$

By the way, in the multi-color image forming apparatus wherein a color image is formed on the recording material by transferring toner images on the recording material wound around the transfer drum 20 is fixed, a relation between the peripheral length L2 of the transfer drum 20, first recording material size L31 and sheet-to-sheet distance La becomes as follows:

$$La=L2-L31 \quad (5)$$

Accordingly, from the above relations (4) and (5), the following relation is established:

$$L1<(L2-L31)+L32 \quad (6)$$

Of course, the following relation is satisfied:

$$L4<L2-L3 \quad (7)$$

Accordingly, from these relations, when a relation $$L1<(L2-L31)+L32 \quad (8)$$

is established, the same operation as those of the first and second embodiments is performed; however, when a relation L1≧ (L2–L31)+L32 is established, after the transfer drum 20 is idly rotated by one revolution, the small size recording material K2 is wound around the transfer drum 20.

Next, such operation will be explained briefly with reference to the flow chart shown in FIG. 3.

After the image formation regarding the preceding recording material is finished (step S1), when the continuous print (step S2) is effected, it is judged whether the recording material (transfer material) size is the same or not (step S3). If same, the second succeeding recording material K2 is gripped (step S4), and the image formation is effected regarding the second recording material (step S5). In the step S3, if the size of the second recording material K2 is changed and when the relation L1<(L2–L31)+L32 is established (step S6), the program goes to the step S4. To the contrary, if such relation is not established, the transfer drum 20 is idly rotated by one revolution (step S7), and then, the second recording material K2 is gripped (step S4).

As mentioned above, according to the present invention, by selecting the length L1 from the supply point to the separation point to become smaller than the sum of the length L3 of the recording material and the sheet-to-sheet distance La and by selecting the length L4 from the transfer point to the separation point to become smaller than the difference (L2–L3) between the peripheral length L2 of the transfer drum and the length L3 of the recording material, for example, if the second succeeding recording material is jammed, since the second recording material can be stopped by the rotary members and the correct image formation can be effected regarding the first preceding recording material (which was conventionally abandoned), the waste recording materials and the image forming time can be greatly reduced.

It should be noted that the present invention is not limited to the aforementioned embodiments, and various alternations and modifications can be effected within the scope of the present invention.

What is claimed is:

1. An image forming apparatus comprising:

an image bearing member capable of rotating while bearing a toner image thereon;

recording material bearing means capable of rotating while bearing a recording material thereon for conveying the recording material to a transfer position, the toner image born on said image bearing member being transferred onto the recording material born on said recording material bearing member at the transfer position;

a pair of rotary members arranged upstream of said recording material bearing means in a recording material conveying direction for pinching and conveying the recording material to said recording material bearing means; and separation means for separating the recording material from said recording material bearing means at a separation position; and detection means for detecting whether the recording material is being carried normally by said recording material bearing means;

wherein when a length from said pair of rotary members to said separation position along a recording material conveying path is L1, a length of the recording material in the recording material conveying direction is L3, a distance from the transfer position to the separation position is L4, and a distance from a trailing end of a first recording material to a leading end of a second recording material on said recording material bearing means when said rotary members convey the first and second recording materials to said recording material bearing means in order to transfer the image on the first recording material and the second recording material successively, is La, the relations $$L_1<(L_3+L_a), \text{ and } L_4<L_a$$

are satisfied, and if said detection means detects that the second recording material is not being carried normally by said recording material bearing means, when said rotary members convey the first recording material and the second recording material successively to said recording material bearing means in order to transfer the image onto the first and second recording materials, said rotary members are stopped while pinching the second recording material therebetween, and said image bearing member and said recording material bearing means continue to rotate at least until the trailing end of the first recording material is separated from said recording material bearing means by said separation means.

2. An image forming apparatus according to claim 1, wherein when a peripheral length of said recording material bearing means is L2, the following relation is satisfied:

$$L2=L3+La.$$

3. An image forming apparatus according to claim 1, further comprising a pair of fixing rotary members for fixing the toner image to the recording material, and wherein a distance between said separation position and said pair of fixing rotary members along the recording material conveying path is selected to be smaller than a length of a maximum recording material available to the image forming apparatus.

4. An image forming apparatus according to claim 2, wherein said recording material bearing means bears the recording material in such a manner that a tip end of the recording material is gripped always at the same position in a peripheral direction of said recording material bearing means.

5. An image forming apparatus according to claim 4, wherein the length L4 is selected to be smaller than the distance La when the maximum size recording materials available to the image forming apparatus are continuously conveyed.

6. An image forming apparatus according to claim 1, wherein said pair of rotary members comprises a pair of regist rollers for conveying the recording material to said recording material bearing means at a predetermined timing.

7. An image forming apparatus according to claim 3, wherein when said detection means detects the fact that the second recording material is not being carried normally by said recording material bearing means, said image bearing member, said recording material bearing means and said pair of fixing rotary members stop.

8. An image forming apparatus according to claim 1, wherein said recording material bearing means conveys the recording material to the transfer position a plurality of times to transfer the images of plural colors onto the recording material superimposedly and sequentially.

9. An image forming apparatus according to claim 8, wherein after a transfer start of the image of a final color to the first recording material, the second recording material is conveyed to said recording material bearing means by said rotary member.

* * * * *

UNITED STATES PATENT AND TRADEMARK OFFICE

CERTIFICATE OF CORRECTION

PATENT NO. : 5,508,796

DATED : April 16, 1996

INVENTOR(S) : HIROSHI SASAME, et al.

It is certified that error appears in the above-indentified patent and that said Letters Patent is hereby corrected as shown below:

COLUMN 1

Line 38, "A--Si" should read --A-Si--.
Line 44, "vias" should read --bias--.

COLUMN 2

Line 52, "born" should read --borne--.

COLUMN 3

Line 34, "miss-supplied" should read --missupplied--.
Line 57, "miss-supplied" should read --missupplied--.

COLUMN 4

Line 4, "miss-supplied" should read --missupplied--.
Line 5, "almost" should read --most--.
Line 9, "associating" should read --associated--.
Line 14, "dangerous-since" should read --dangerous since--.

UNITED STATES PATENT AND TRADEMARK OFFICE

CERTIFICATE OF CORRECTION

PATENT NO. : 5,508,796 Page 2 of 3

DATED : April 16, 1996

INVENTOR(S) : HIROSHI SASAME, et al.

It is certified that error appears in the above-indentified patent and that said Letters Patent is hereby corrected as shown below:

COLUMN 5

Line 27, "drum" should read --drum 20--.
Line 37, "length" should read --lengths--.
Line 40, "sum" should read --the sum--.

COLUMN 6

Line 27, "almost" should read --most--.
Line 58, "10" should be deleted.

COLUMN 9

Line 8, "minimum" should read --a minimum--; and "loosing" should read --losing--.
Line 11, "damaging" should read --being damaged--.

COLUMN 10

Line 15, "is" should be deleted.

UNITED STATES PATENT AND TRADEMARK OFFICE

CERTIFICATE OF CORRECTION

PATENT NO. : 5,508,796 Page 3 of 3

DATED : April 16, 1996

INVENTOR(S) : HIROSHI SASAME, et al.

It is certified that error appears in the above-indentified patent and that said Letters Patent is hereby corrected as shown below:

COLUMN 11

Line 15, "born" should read --borne--.
Line 16, "born" should read --borne--.
Line 17, "member" should read --means--.

COLUMN 12

Line 2, "ther-" should read --there--.
Line 3, "ebetween," should read --between,--.

Signed and Sealed this

Eighth Day of October, 1996

Bruce Lehman

*Attest:*

BRUCE LEHMAN

*Attesting Officer*

*Commissioner of Patents and Trademarks*